US006371038B1

(12) United States Patent
Beauchamp et al.

(10) Patent No.: US 6,371,038 B1
(45) Date of Patent: Apr. 16, 2002

(54) LATERAL TUNNEL THRUSTER PROPELLER CONTROL METHOD AND SYSTEM

(75) Inventors: Charles H. Beauchamp, Jamestown; Christopher F. Hillenbrand, Portsmouth, both of RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/684,082

(22) Filed: Oct. 10, 2000

(51) Int. Cl.[7] ..... B63H 25/46; B63H 21/22
(52) U.S. Cl. ..... 114/151; 440/1; 701/1
(58) Field of Search ..... 114/144 R, 150, 114/151; 440/1; 701/1; 416/26, 87, 88, 89

(56) References Cited

U.S. PATENT DOCUMENTS 3,974,792 A * 8/1976 Burnell et al. ..... 114/144 B
4,747,359 A * 5/1988 Ueno ..... 114/144 B
5,951,607 A * 9/1999 Senn et al. ..... 701/1

* cited by examiner

*Primary Examiner*—S. Joseph Morano
*Assistant Examiner*—Andrew Wright
(74) *Attorney, Agent, or Firm*—Michael J. McGowan; Prithvi C. Lall; Michael E. Oglo

(57) ABSTRACT

A method and system is provided that improves the maneuverability of a marine vehicle having a lateral tunnel thruster. When the marine vehicle moves at a forward speed through water, a water flow having a fluid velocity moves through the thruster. The thruster's propeller is turned at a substantially constant rate of rotation and the fluid velocity in the tunnel is measured. The pitch angle of the propeller is adjusted based on the measured fluid velocity.

14 Claims, 1 Drawing Sheet

LATERAL TUNNEL THRUSTER PROPELLER CONTROL METHOD AND SYSTEM

STATEMENT OF GOVERNMENT INTEREST

The invention described herein may be manufactured and used by or for the Government of the United States of America for Governmental purposes without the payment of any royalties thereon or therefor.

BACKGROUND OF THE INVENTION (1) Field of the Invention

The present invention relates generally to marine vehicle maneuverability, and more particularly to a method and system for improving the maneuverability of a marine vehicle equipped with a lateral tunnel thruster by controlling the pitch angle of a tunnel thruster's propeller.

(2) Description of the Prior Art

Marine vehicles typically use rudders or other control surfaces to produce maneuvering forces. However, flow over the control surfaces is required to produce a maneuvering force that varies with the square of the vehicle speed. Therefore, at low speed, control surfaces become ineffective. To combat this problem, tunnel thrusters have been located in the bow or stern of marine vehicles to meet lateral low speed maneuvering requirements.

In general, a lateral tunnel thruster has a rotating propeller installed in a laterally traversing tunnel extending through the vehicle. The rotating propeller creates a pressure differential across the blades and drives a jet of water through the tunnel and out one side. The integrated pressure force on the blades is transferred to the vehicle as a force acting in the opposite direction of the jet flow which, in turn, is used to maneuver the vehicle. For most applications, lateral tunnel thrusters are designed to be reversible so that the vehicle may be maneuvered in either port or starboard directions.

Unfortunately, the effectiveness of tunnel thrusters decreases with forward velocity of the vehicle. Further, there is often an intermediate vehicle speed at which neither the control surfaces nor the thruster produce effective maneuvering forces. Studies that measure the effects of forward vehicle velocity on tunnel thrust performance show that as the forward velocity increases, the effective side force (i.e., force perpendicular to the vehicle axis) from the tunnel thruster decreases to as low as ten percent of the side force measured at zero forward vehicle velocity. In other words, tunnel thrusters quickly lose their maneuvering effectiveness as forward vehicle velocity increases.

Experiments conducted to understand this phenomenon indicate that the forward velocity on the vehicle significantly increases fluid velocity through the tunnel for a fixed rotor speed. This results in the propeller blade operating off design and unloading the blades which results in less thrust on the vehicle.

SUMMARY OF THE INVENTION

Accordingly, it is an object of the present invention to provide a method and system that improves the maneuverability of a marine vehicle.

Another object of the present invention is to provide a method and system for improving the efficiency of a marine vehicle's lateral tunnel thruster.

Still another object of the present invention is to provide a method and system for improving the performance of a marine vehicle's lateral tunnel thruster regardless of the forward vehicle speed.

Other objects and advantages of the present invention will become more obvious hereinafter in the specification and drawings.

In accordance with the present invention, a method and system is provided that improves the maneuverability of a marine vehicle. The marine vehicle is one that has a lateral tunnel in which a propeller is mounted such that, when the marine vehicle moves at a forward speed through water, a water flow having a fluid velocity moves through the lateral tunnel. The propeller is turned at a substantially constant rate of rotation and the fluid velocity in the tunnel is measured either directly or indirectly as a function of the vehicle's forward speed. The pitch angle of the propeller is adjusted based on the measured fluid velocity.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DESCRIPTION OF THE PREFERRED EMBODIMENT(S)

Figure 1:
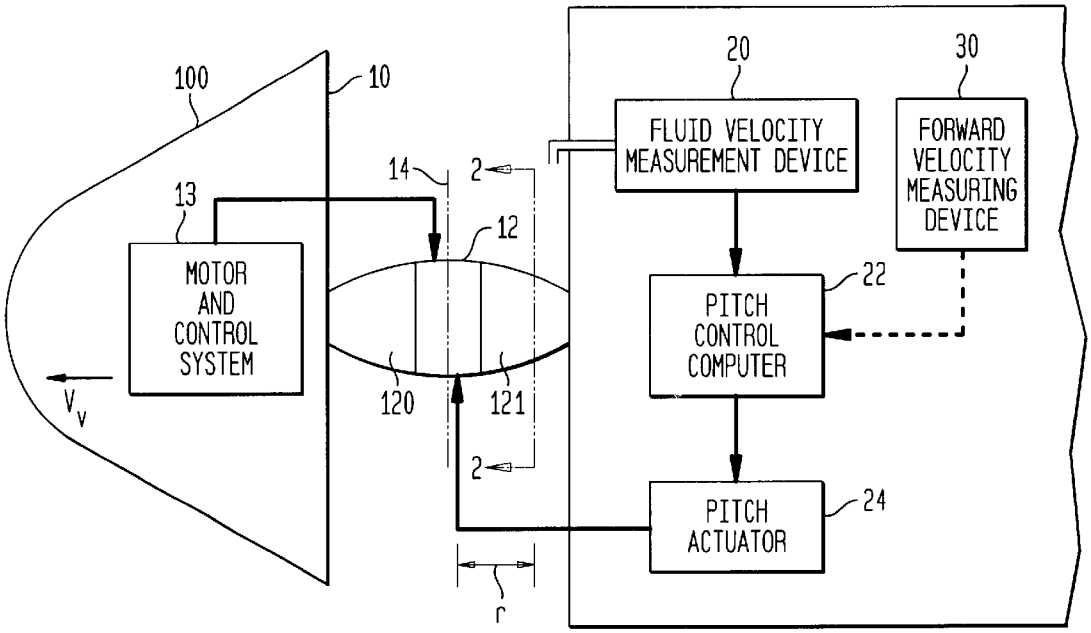
FIG. 1 is a schematic view of the forward section of a marine vehicle having a lateral tunnel thruster with a propeller pitch control system coupled thereto in accordance with an embodiment of the present invention.

Referring now to the drawings, and more particularly to FIG. 1, the forward section of a marine vehicle 100 is illustrated. Marine vehicle 100 is representative of any manned or unmanned marine vehicle having a lateral tunnel 10 formed therethrough. While more than one such tunnel could be present in marine vehicle 100, only one such tunnel need be illustrated/described for an understanding of the present invention.

Mounted in tunnel 10 is a thruster or propeller 12 having multiple blades of which blades 120 and 121 are shown. The mechanical structure for mounting propeller 12 in tunnel 10 is well understood in the art and is not a limitation of the present invention. Accordingly, the mechanical structure for mounting propeller 12 in tunnel 10 is omitted for clarity of illustration. Propeller 12 is capable of rotation about its axis of rotation 14. The speed of rotation is governed by a motor and control system 13 coupled to propeller 12. Typically, propeller 12 can be rotated in either direction about axis 14 to generate thrust in either of directions 16 or 18.

Figure 2:
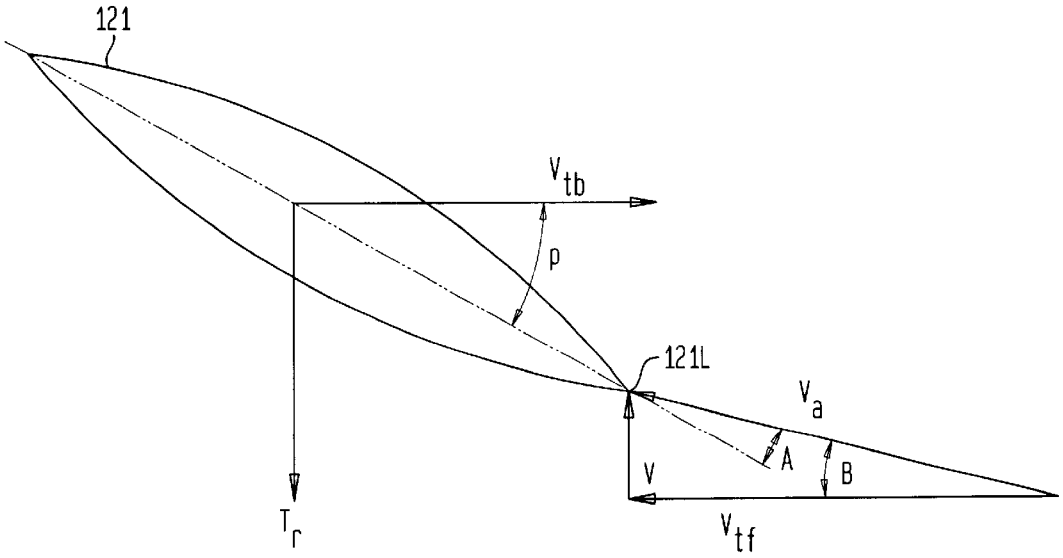
FIG. 2 is a cross-section of the propeller taken along lines 2—2 in FIG. 1 depicting the various forces, velocities and angles related to the propeller.

The basic goal of the present invention is to mitigate the effect of forward velocity $V_v$ of marine vehicle 100 on the thrust produced by propeller 12 in either of directions 16 or 18. This is accomplished by adjusting the pitch angle of propeller 12 as fluid velocity V in tunnel 10 changes. Referring additionally to the cross-section of propeller blade 121 illustrated in FIG. 2, the basic principle of the present invention will be explained. In FIG. 2, fluid velocity in tunnel 10 is designated as V. A thrust force $T_r$ is generated by blade 121 at a nominal radius r measured from axis of rotation 14. Note that the overall thrust on marine vehicle 100 is each thrust force $T_r$ integrated over the radiallyextending length of all of the blades of propeller 12. The thrust force $T_r$ at any given cross-section of blade 121 is strongly dependent on the angle of attack A measured between the apparent fluid velocity $V_a$ entering the leading edge 121L of blade 121. The maximum thrust at nominal radius r is obtained for an optimum angle of attack.

The apparent velocity $V_a$ is the resultant velocity from the vector sum of the (axial) fluid velocity V through tunnel 10 and the tangential fluid velocity $V_{tf}$ experienced by blade 121 due to its rotation. The tangential fluid velocity $V_{tf}$ is equal in magnitude and opposite in direction to the tangential blade velocity $V_{tb}$. For any given $V_{tf}$, $$V_{tf}=V_{tb}=2\ rN \tag{1}$$

where r is the nominal radius of section of a blade such as blade 121, and N is the rate of rotation of propeller 12 in revolutions per unit time. The angle B of apparent velocity $V_a$ is $$B=\arcsin\ (V/V_{tf})=\arcsin\ (V/(2rN)) \tag{2}$$

The angle of attack A at nominal radius r is $$A=B-p \tag{3}$$

where p is the pitch angle of blade 121 at nominal radius r. Therefore, if the rate of rotation N is maintained constant or substantially constant, the angle B of apparent velocity $V_a$ will change as the axial fluid velocity V in tunnel 10 changes. However, the optimum angle of attack A can be maintained by rotating blade 121 to change pitch angle p to compensate for changes in the apparent velocity angle B. In other words, by operating propeller 12 at a fixed rate of rotation N, the present invention can maintain a maximum thrust at nominal radius r by setting the pitch angle p as follows $$p=[\arcsin\ (V/(2\ rN))]-A \tag{4}$$

Since an optimum angle of attack A at a nominal radius r is known, or can be determined for a given propeller based on historical data or computational analysis tools, it is only necessary in the present invention to know the propeller's rate of rotation N and to measure fluid velocity V in tunnel 10 in order to select the proper pitch angle p for maximum thrust.

The method of the present invention can be implemented in a variety of ways, several of which will be described herein. Referring again to FIG. 1, a fluid velocity measuring device 20 can be installed in tunnel 10 to provide a direct measurement of fluid velocity V. Device 20 can be any one or more devices that can measure (axial) fluid velocity V moving in either direction through tunnel 10. Non-limiting examples of device 20 include ultrasonic flow meters, magnetic flow meters, turbine meters, pitot static tubes and Kiel probes, all of which are well known in the art. The measured velocity is input to a pitch control computer 22 programmed to calculate pitch angle p as described above. Computer 22 supplies the computed pitch angle p to a pitch actuator 24 coupled to propeller 12. Pitch actuator 24 can be any mechanism used to vary the pitch angle on a rotating blade propeller. Such mechanisms are well know in a variety of applications to include marine vehicles, airplanes, helicopters and windmills. Accordingly, the choice of pitch actuator 24 is not a limitation on the present invention.

The present invention could also be implemented by making an indirect measurement of fluid velocity and supplying same to pitch control computer 22. For example, since most marine vehicles are equipped with a device to measure the forward velocity of the vehicle, the present invention could make use of an already-provided forward velocity measuring device 30 to supply vehicle velocity $V_v$ to pitch control computer 22. Conversion of forward velocity $V_v$ to axial fluid velocity V in tunnel 10 could be computed using empirical data relating vehicle velocity to fluid velocity V for the particular marine vehicle. This indirect form of measuring fluid velocity V can be used as an alternative, a back-up or a secondary fluid velocity measurement. The primary advantage of the indirect measurement is that it eliminates the need to mount device 20 in tunnel 10.

The present invention is also not limited by the particular algorithm for pitch angle p described above. The optimum pitch angle p could also be predicted from historical propeller data or from computational analysis tools. For example, experiments could be used to determine a precise relationship (to be used by computer 22) between maximum thrust, fluid velocity in tunnel 10 and pitch angle p for a particular marine vehicle/tunnel propeller geometry.

The advantages of the present invention are numerous. The performance of a marine vehicle's lateral tunnel thrust is greatly improved as the thruster's efficiency is automatically maintained over changing vehicle speed. In this way, the tunnel thruster can be used to maneuver a marine vehicle at slower and higher forward vehicle velocities. The method and system are easily implemented using commercially-available sensors, computers and pitch actuators.

It will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. A method of improving the maneuverability of a marine vehicle, comprising the steps of:

providing a marine vehicle having a lateral tunnel in which a propeller is mounted wherein, when said marine vehicle moves at a forward speed through water, a water flow having a fluid velocity moves through said lateral tunnel;

turning said propeller at a substantially constant rate of rotation;

measuring said fluid velocity; and adjusting a pitch angle of said propeller based on said fluid velocity.

2. A method according to claim 1 wherein said propeller has an axis of rotation and has an angle of attack A at a nominal radius r measured from said axis of rotation that generates a maximum thrust in said lateral tunnel, and wherein said step of adjusting comprises the step of setting said pitch angle at said nominal radius r equal to $$[\arcsin\ (V/(2\ rN))]-A$$

where V is said fluid velocity, and

N is said substantially constant rate of rotation.

3. A method according to claim 1 wherein said step of measuring comprises the step of measuring said fluid velocity directly in said lateral tunnel.

4. A method according to claim 1 wherein said step of measuring comprises the step of measuring said fluid velocity indirectly as a function of said forward speed of said marine vehicle.

5. A system for improving the maneuverability of a marine vehicle having a lateral tunnel in which a propeller is mounted wherein, when said marine vehicle moves at a forward speed through water, a water flow having a fluid velocity moves through said lateral tunnel, said system comprising:

means for turning said propeller at a substantially constant rate of rotation;

means for measuring said fluid velocity; and means for adjusting a pitch angle of said propeller based on said fluid velocity.

6. A system as in claim 5 wherein said means for measuring is mounted in said lateral tunnel.

7. A system as in claim 6 wherein said means for measuring is selected from the group consisting of ultrasonic flowmeters, magnetic flowmeters, turbine meters, pitot static tubes and Kiel probes.

8. A system as in claim 5 wherein said means for measuring comprises:

means mounted on said marine vehicle to measuring said forward speed; and means for determining said fluid velocity as a function of said forward speed.

9. A system as in claim 5 wherein said propeller has an axis of rotation and has an angle of attack A at a nominal radius r measured from said axis of rotation that generates a maximum thrust in said lateral tunnel, and wherein said means for adjusting comprises means for setting said pitch angle at said nominal radius r equal to $$[\arcsin (V/(2\ rN))]-A$$

where V is said fluid velocity, and

N is said substantially constant rate of rotation.

10. A system for improving the maneuverability of a marine vehicle, comprising:

a marine vehicle having at least one lateral tunnel formed therein;

a propeller mounted in said lateral tunnel wherein, when said marine vehicle moves at a forward speed through water, a water flow having a fluid velocity moves through said lateral tunnel;

means for turning said propeller at a substantially constant rate of rotation;

means for measuring said fluid velocity; and means for adjusting a pitch angle of said propeller based on said fluid velocity.

11. A system as in claim 10 wherein said means for measuring is mounted in said lateral tunnel.

12. A system as in claim 11 wherein said means for measuring is selected from the group consisting of ultrasonic flowmeters, magnetic flowmeters, turbine meters, pitot static tubes and Kiel probes.

13. A system as in claim 10 wherein said means for measuring comprises:

means mounted on said marine vehicle to measuring said forward speed; and means for determining said fluid velocity as a function of said forward speed.

14. A system as in claim 10 wherein said propeller has an axis of rotation and has an angle of attack A at a nominal radius r measured from said axis of rotation that generates a maximum thrust in said lateral tunnel, and wherein said means for adjusting comprises means for setting said pitch angle at said nominal radius r equal to $$[\arcsin (V/(2\ rN))]-A$$

where V is said fluid velocity, and

N is said substantially constant rate of rotation.

* * * * *